US007604519B2

(12) United States Patent
Wu

(10) Patent No.: US 7,604,519 B2
(45) Date of Patent: Oct. 20, 2009

(54) CONNECTOR ASSEMBLY WITH IMPROVED CONTACTS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 217 days.

(21) Appl. No.: 11/801,947

(22) Filed: May 10, 2007

(65) Prior Publication Data

US 2008/0280496 A1 Nov. 13, 2008

(51) Int. Cl.
*H01R 13/11* (2006.01)

(52) U.S. Cl. ..... 439/857; 439/924.1

(58) Field of Classification Search ..... 439/857, 439/924.1, 856, 850

See application file for complete search history.

(56) References Cited

U.S. PATENT DOCUMENTS 4,343,523 A * 8/1982 Cairns et al. ..... 439/588
4,734,041 A * 3/1988 Bruchmann et al. ..... 439/637
5,080,613 A * 1/1992 Orui et al. ..... 439/660
5,458,513 A * 10/1995 Matsuoka ..... 439/857
5,463,210 A * 10/1995 Imura ..... 235/441
6,402,571 B1 6/2002 Muller et al.
6,527,590 B2 * 3/2003 Oguchi ..... 439/630
6,652,322 B2 * 11/2003 Ito et al. ..... 439/637
D494,545 S 8/2004 Kuroda
6,776,635 B2 * 8/2004 Blanchfield et al. ..... 439/181
6,840,824 B2 * 1/2005 Harada et al. ..... 439/857
7,008,250 B2 * 3/2006 Shuey et al. ..... 439/265
7,056,158 B2 6/2006 Kuroda
7,338,329 B2 * 3/2008 Yang ..... 439/675

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A connector assembly (100) includes an insulative housing (1) defining a number of receiving passages (101), and a number of conductive contacts (2) housed in corresponding receiving passages. Each conductive contact includes a first contacting finger (210) and a second contacting finger (212) extending substantially along a mating direction and toward each other and respectively exposed in corresponding receiving passage of the insulative housing for electrically engaging with the same contact of a complementary connector. The first contacting finger and the second contacting finger each have an inclined branch (2101) and a contacting point (2102). The projections of the contacting points of the first and second contacting fingers along a lateral direction perpendicular to the mating direction form a first gap, and the smallest vertical distance between the contacting point of the first contacting finger and the branch of the second contacting finger forms a second gap. The second gap is always larger than the first gap.

19 Claims, 9 Drawing Sheets

3

CONNECTOR ASSEMBLY WITH IMPROVED CONTACTS

BACKGROUND OF THE INVENTION

1. Field of the Invention

The present invention generally relates to a connector assembly, and more particularly to a high-current power connector assembly used for power transmission.

2. Description of the Prior Art

Power plug and board end connector are commonly used in computers, game machines, etc. to provide power for these equipments. Conventional power plug comprises a housing containing a plurality of power contacts, a cable electrically connecting with the power contacts, and an outer cover enclosing the conjunctions between the cable and the power contacts. Each power contact may dispose a pair of contacting fingers symmetrically arranged relative to each other for engaging with a corresponding board end connector, as disclosed by U.S. Pat. Nos. 7,056,158, 6,402,571, 6,840,824, or D494,545S. The pair of contacting fingers as disclosed in above patents together sandwich contacts of corresponding board end connector to realize the power transmission therebetween. It is obvious that there is a relative big gap formed between the pair of contacting fingers along a lateral direction perpendicular to mating direction thereof, thus, such contact structure is easy to be stamped from a metal sheet and easy to be plated. However, for enhancing the mating force between the power plug and the board end connector, the pair of contacting fingers may be stamped to have curved contacting points curved toward each other and locate close to each other, such as disclosed by U.S. Pat. No. 6,840,824B2. Such arrangement of the contacting points causes the distance between the contacting points along lateral direction is too small which certainly assure the reliable mating force. However, the too close contacting fingers are hard to be stamped or be plated. Thus, it is desired to design a power connector with improved contact structure to be easily plated and stamped.

SUMMARY OF THE INVENTION

Accordingly, an object of the present invention is to provide a connector assembly with improved contact structure for easily stamped or plated.

In order to achieve the above-mentioned object, a connector assembly in accordance with the present invention comprises an insulative housing defining a plurality of receiving passages, and a plurality of conductive contacts housed in corresponding receiving passages. Each conductive contact comprises a first contacting finger and a second contacting finger extending substantially along a mating direction and toward each other and respectively exposed in corresponding receiving passage of the insulative housing for electrically engaging with the same contact of a complementary connector. The first contacting finger and the second contacting finger each have an inclined branch and a contacting point. The projections of the contacting points of the first and second contacting fingers along a lateral direction perpendicular to the mating direction form a first gap, and the smallest vertical distance between the contacting point of the first contacting finger and the branch of the second contacting finger forms a second gap. The second gap is always larger than the first gap.

Other objects, advantages and novel features of the invention will become more apparent from the following detailed description of the present embodiment when taken in conjunction with the accompanying drawings.

DETAILED DESCRIPTION OF THE INVENTION

Figure 1:
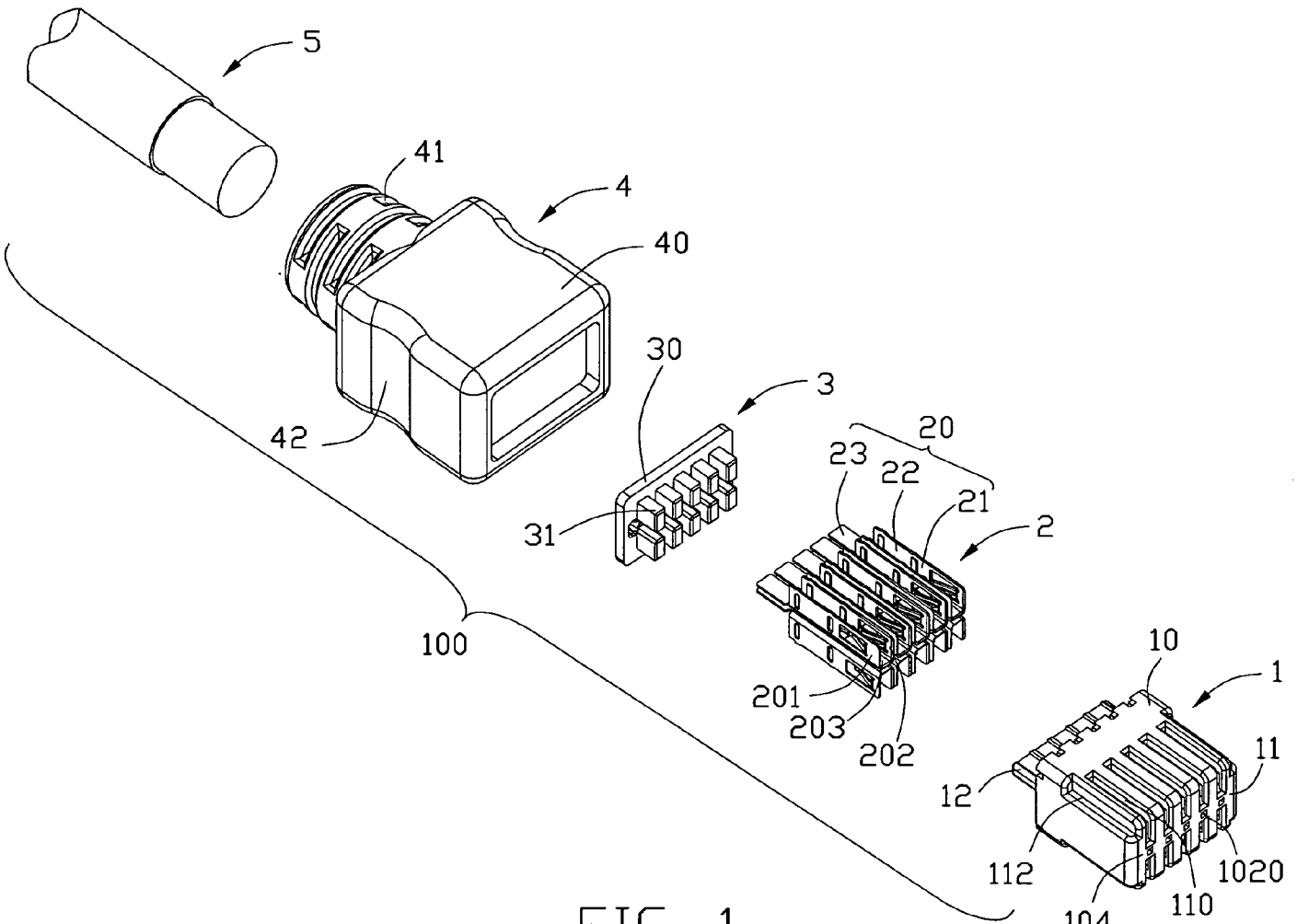
FIG. 1 is an exploded, perspective view of a connector assembly in accordance with the present invention.

Reference will now be made to the drawing figures to describe the present invention in detail.

Figure 2:
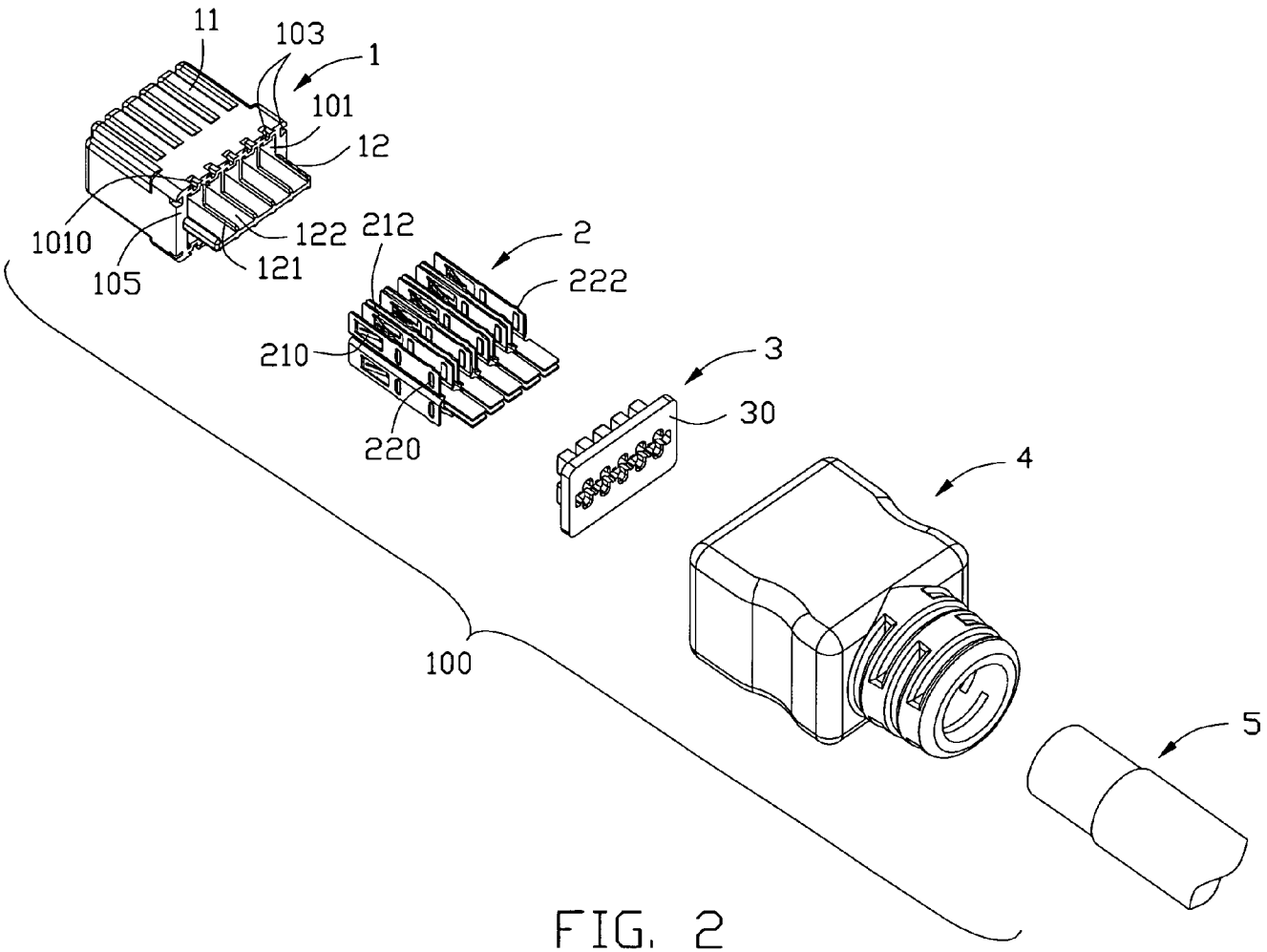
FIG. 2 is a view similar to FIG. 1, but viewed from a different aspect.

Please refer to FIGS. 1-2, a connector assembly 100 in accordance with the present invention comprises an insulative housing 1, two sets of conductive contacts 2 housed in the insulative housing 1, a spacer 3 assembled to the insulative housing 1 and the contacts 2, a cable 5 electrically connecting with the contacts 2, and a cover 4 enclosing the contact area between the contacts 2 and the cable 5, the spacer 3 and the rear portion of the insulative housing 1.

Figure 6:
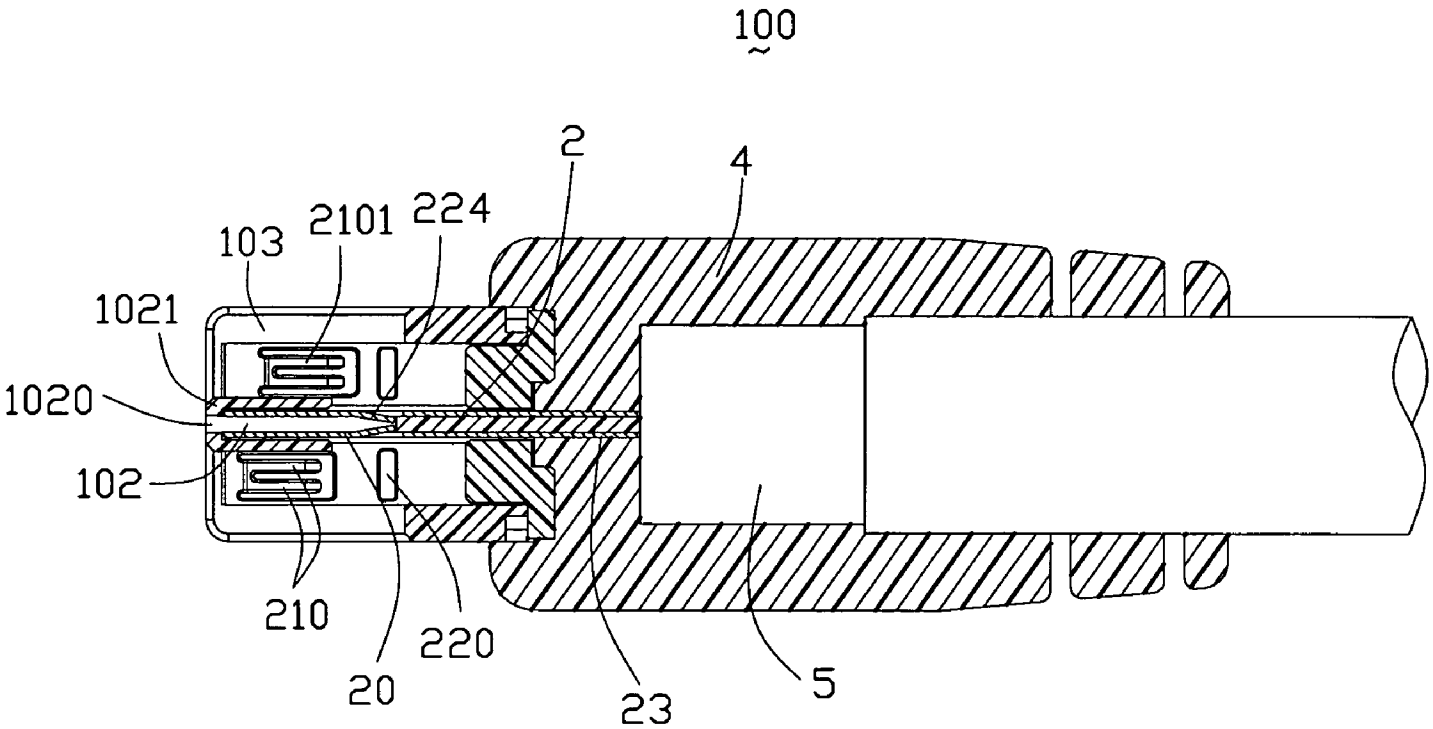
FIGS. 6-8 are cross-section views of the connector assembly taken along lines 6-6 to 8-8 of FIG. 5.
Figure 7:
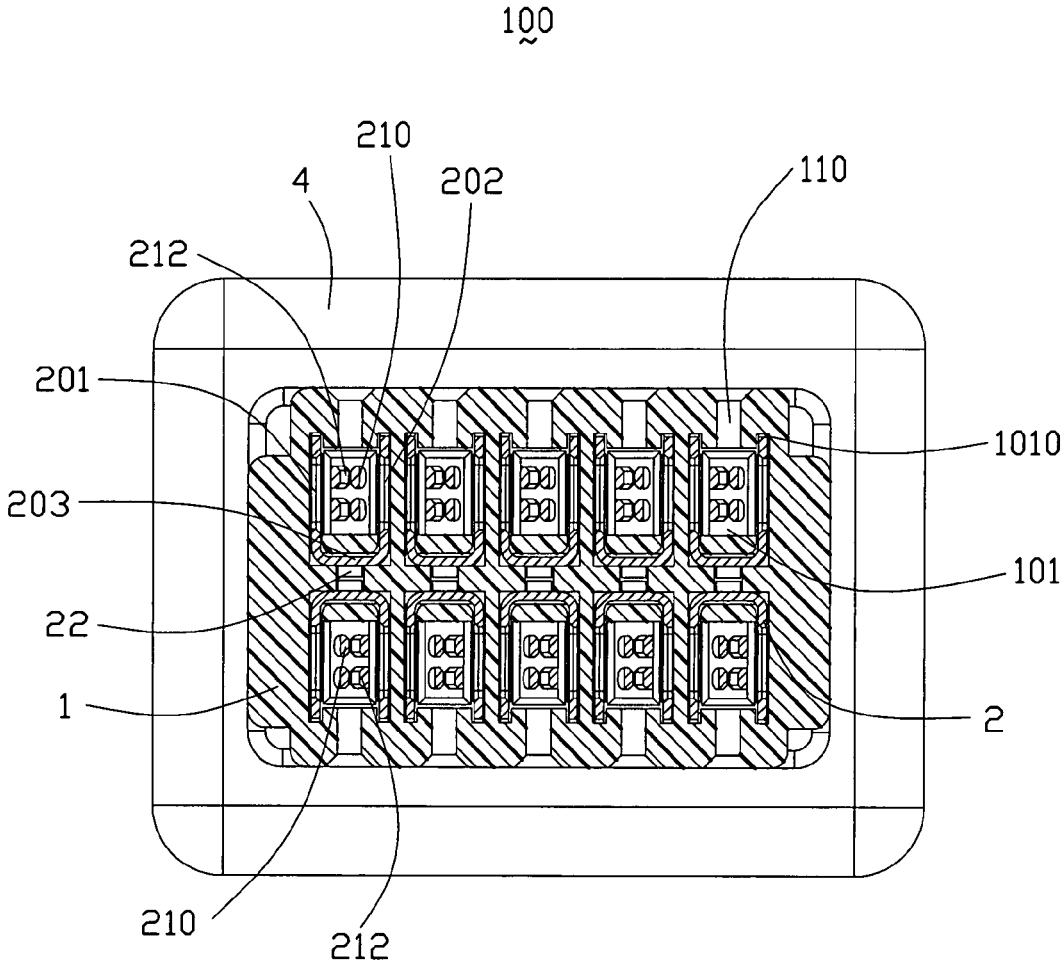

The insulative housing 1 comprises a middle base portion 10, a mating portion 11 extending forwardly from the base portion 10 and a supporting portion 12 extending rearwardly from the base portion 10. Two rows of receiving passages 101 arranged along up-to-down direction protrude from a rear surface 105 of the base portion 10 till adjacent to a front surface 104 of the mating portion 11, while not communicating with the front surface 104 of the mating portion 11. Each receiving passage 101 defines a pair of slits 1010 in inner surface thereof for interferentially fitting with the conductive contacts 2, that is, the receiving passage 101 of the top row defines the pair of slits 1010 on upper inner edge thereof, while, the receiving passage 101 of the lower row defines the pair of slits 1010 on lower inner edge thereof. A row of slots 102 is aligned between the two rows of receiving passages 101 in up-to-down direction with a narrower entrance 1020 communicating with the front surface 104 of the mating portion 11, thus, forming a pair of steps 1021 (FIG. 6) in the inner walls of the slots 102. In addition, each slot 102 communicates with corresponding pair of receiving passages 101 aligned along the up-to-down direction in rear section thereof. Two rows of L-shape openings 110 arranged respectively above and below corresponding receiving passages 101 and protrude inwardly from top, bottom surfaces and the front surface 104 at the same time, thus, the openings 110 open toward outside. Four recesses, 112 are respectively formed at four corners of the mating portion 11 for integral configuration. A plurality of notches 103 are defined along outer periphery of the rear edge of the base portion 10 and communicate with the outside and the rear surface 105. The supporting portion 12 forms a plurality of partition ribs 121 on upper and lower surfaces thereof, thus, forming a plurality of channels 122 to communicate with corresponding receiving passage 101.

Now referring to FIGS. 1-2, the conductive contacts 2 are arranged into an upper row and a lower row after rotating the upper row 180 degrees. Each contact 2 comprises a U-shape main section 20 served as a front mating section 21 and a middle retention section 22 and a flat section 23 served as a tail section 23. The U-shape main section 20 comprises a first flange 201, a second flange 202 opposite to the first flange 201 and both arranged in vertical planes, and a connecting section 203 located in a horizontal plane and connecting the first and second flanges 201, 202. The front part of the main section 20 is served as the mating section 21 and is stamped with a pair of first and second contacting fingers 210, 212 with the same structure and asymmetric position relationship. Each contacting finger 210, 212 extends from a front edge of a frame (not labeled), that is the boot of each contacting finger 210, 212. The boot of the first contacting finger 210 locates more closer to the front edge of the main section 20 than that of the second contacting finger 212 along front-to-back direction. Each contacting finger 210, 212 comprises a pair of inclined branches 2101 (FIG. 6, FIG. 8) bifurcating from the root thereof and curved toward the other contacting finger 212, 210 to form a pair of contacting points 2102 (FIG. 8) also in front-back relationship. Therefore, each contact 2 comprises four contacting points 2102 consisting by the four branches 2101 of the contacting fingers 210, 212 to electrically contact with a complementary connector.

Figure 8:
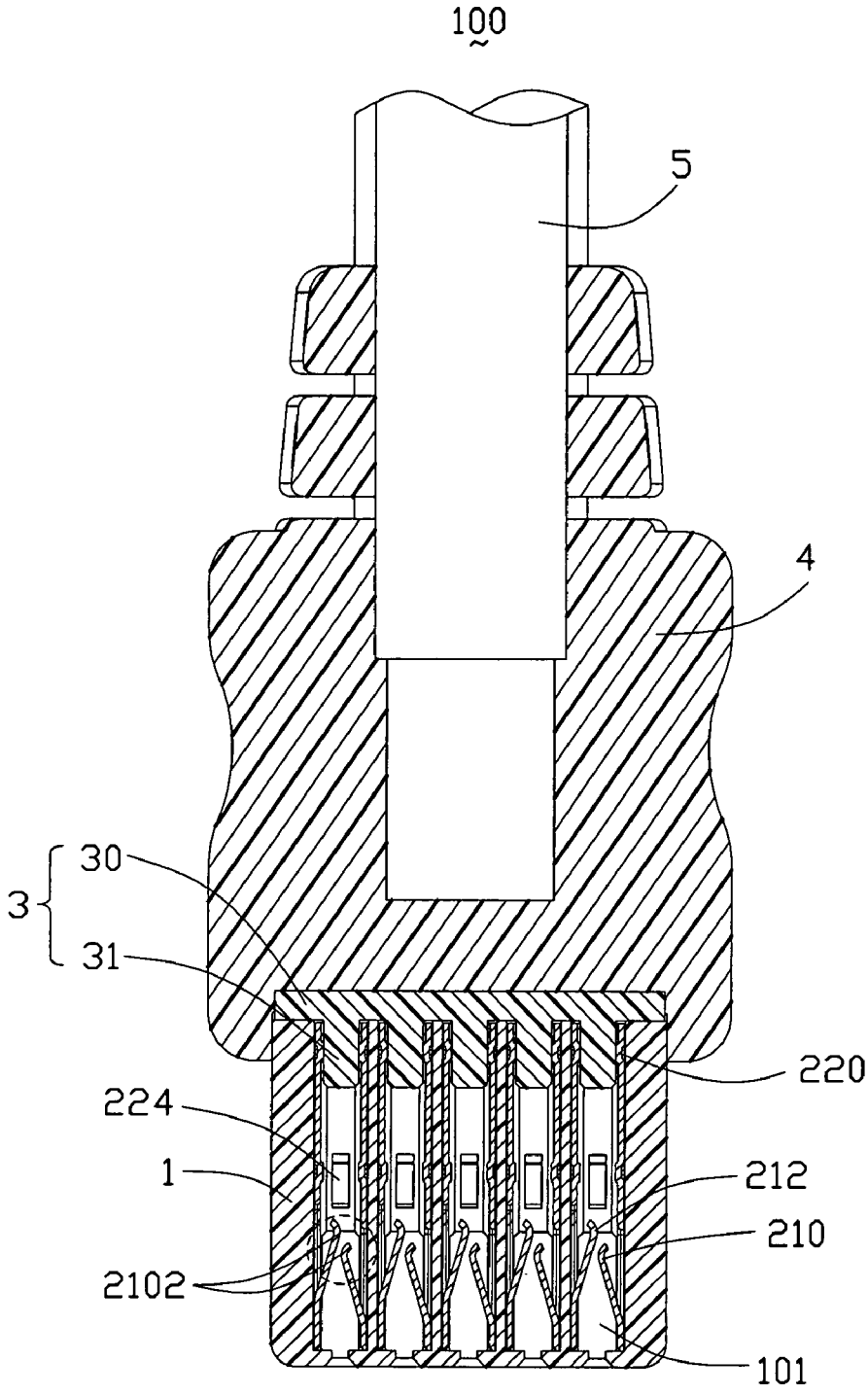
Figure 9:
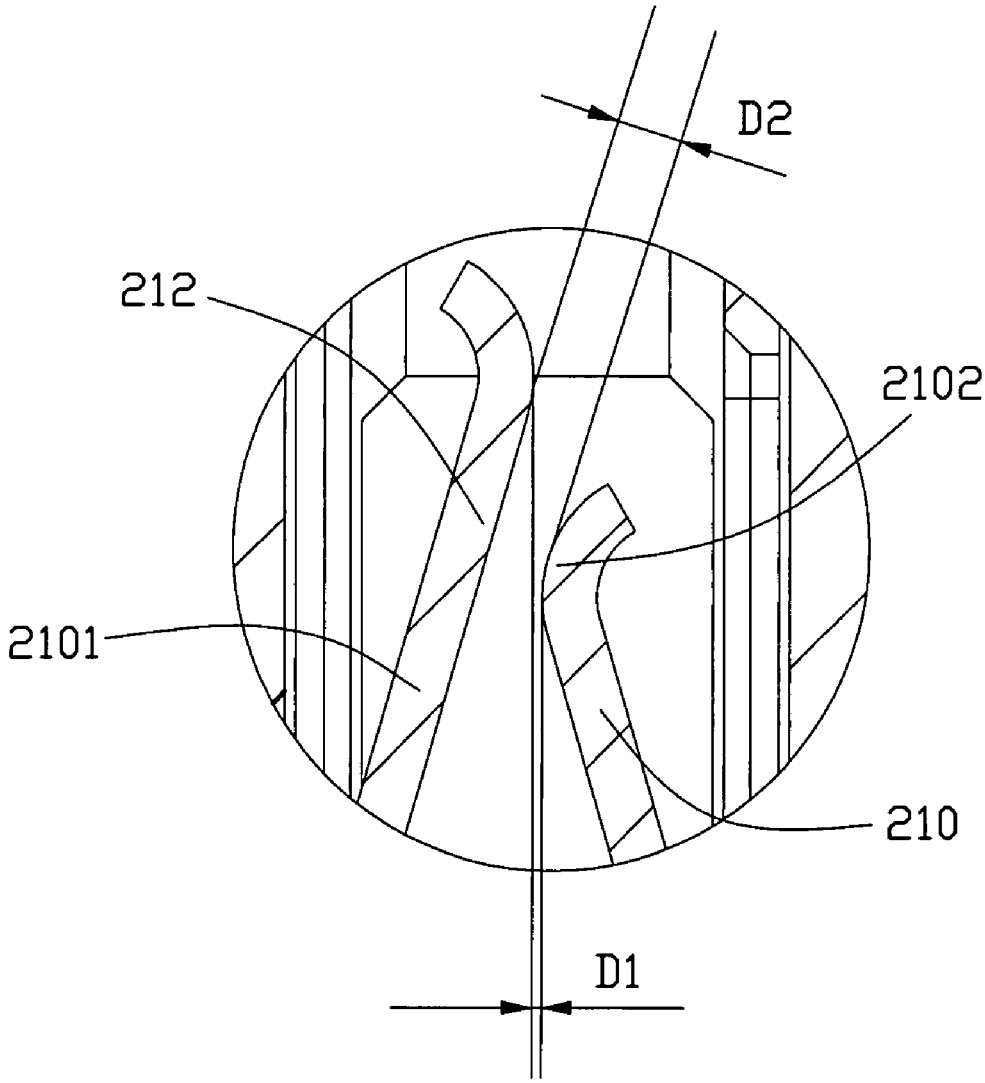
FIG. 9 is an enlarged view of a circled area shown in FIG. 8.

Please refer to FIGS. 8 and 9, since the contacting points 2102 of the first and second contacting fingers 210, 212 are arranged to locate one after another along a mating direction, the projections of the contacting points 2102 of the first and the second contacting fingers 210, 212 along the lateral direction form a first gap, called D1, equaling substantially to 0 mm or smaller than 0 mm for increasing mating force with a complementary connector. D1 is smaller than 0 mm means that the first and second contacting fingers partially overlap with each other viewed from top elevation to cause the projections of the pair of contacting points 2102 is a minus, thus, has relatively big mating force. While, a second gap, called D2, is bigger than the first GAP for easy plating and stamping process. The second gap is a smallest vertical distance between the contacting points 2102 of the first contacting fingers 210 to the inclined branches 2101 of the second contacting fingers 212. Two pairs of protruding points 220 stamped with the first and second flanges 201, 202 are formed on the rear part of the main section 20 for enhancing the connection with the spacer 3. The upper and lower edges of first and second flanges 201, 202 is formed with a plurality of barbs 222 interferentially fitting with the slits 1010 of the housing 1 for enhancing the connection with the insulative housing 1. A retention tab 224 is formed adjacent to the front pair of protruding points 220 and bends toward the other retention tab 224 to be interferentially received in the slots 102 for positioning the contacts 2 relative to the housing 1. The flat tail section 23 in the present invention is a soldering section, but in alternative embodiments, the tail section 23 also can be a crimp structure to crimp corresponding conductor of the cable 5.

Figure 3:
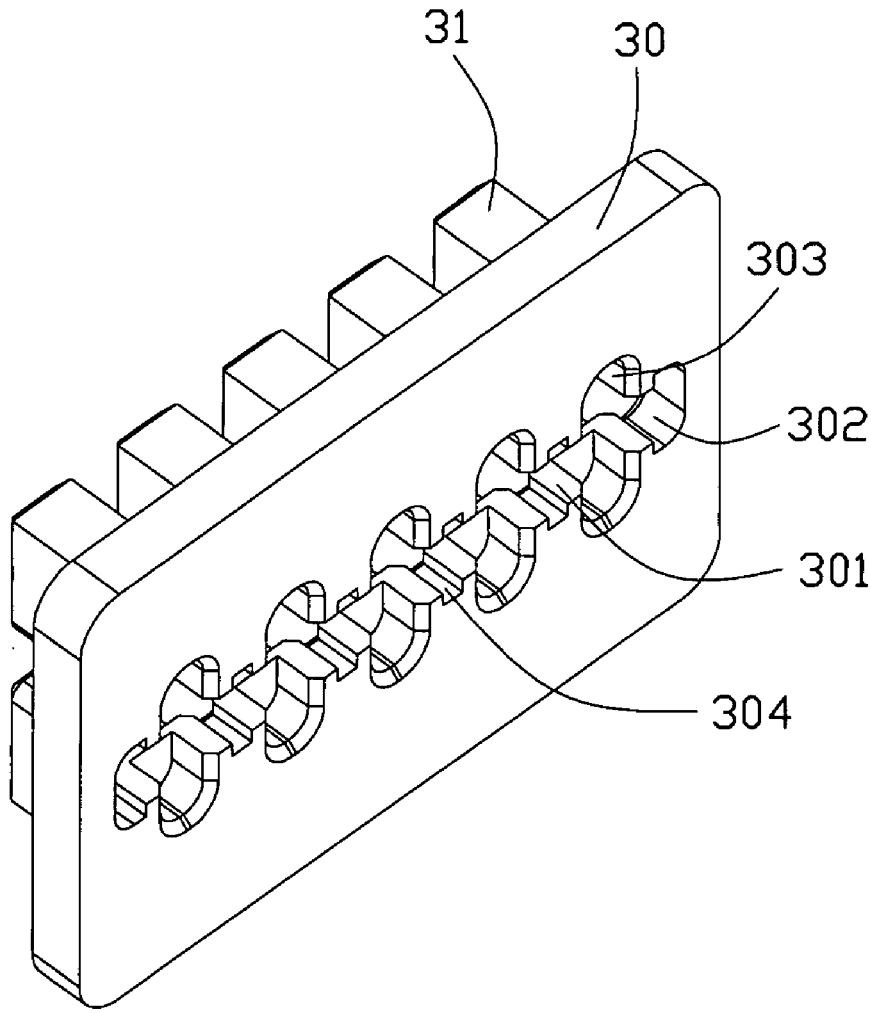
FIG. 3 is an enlarged view of a spacer of the connector assembly of the present invention.
Figure 4:
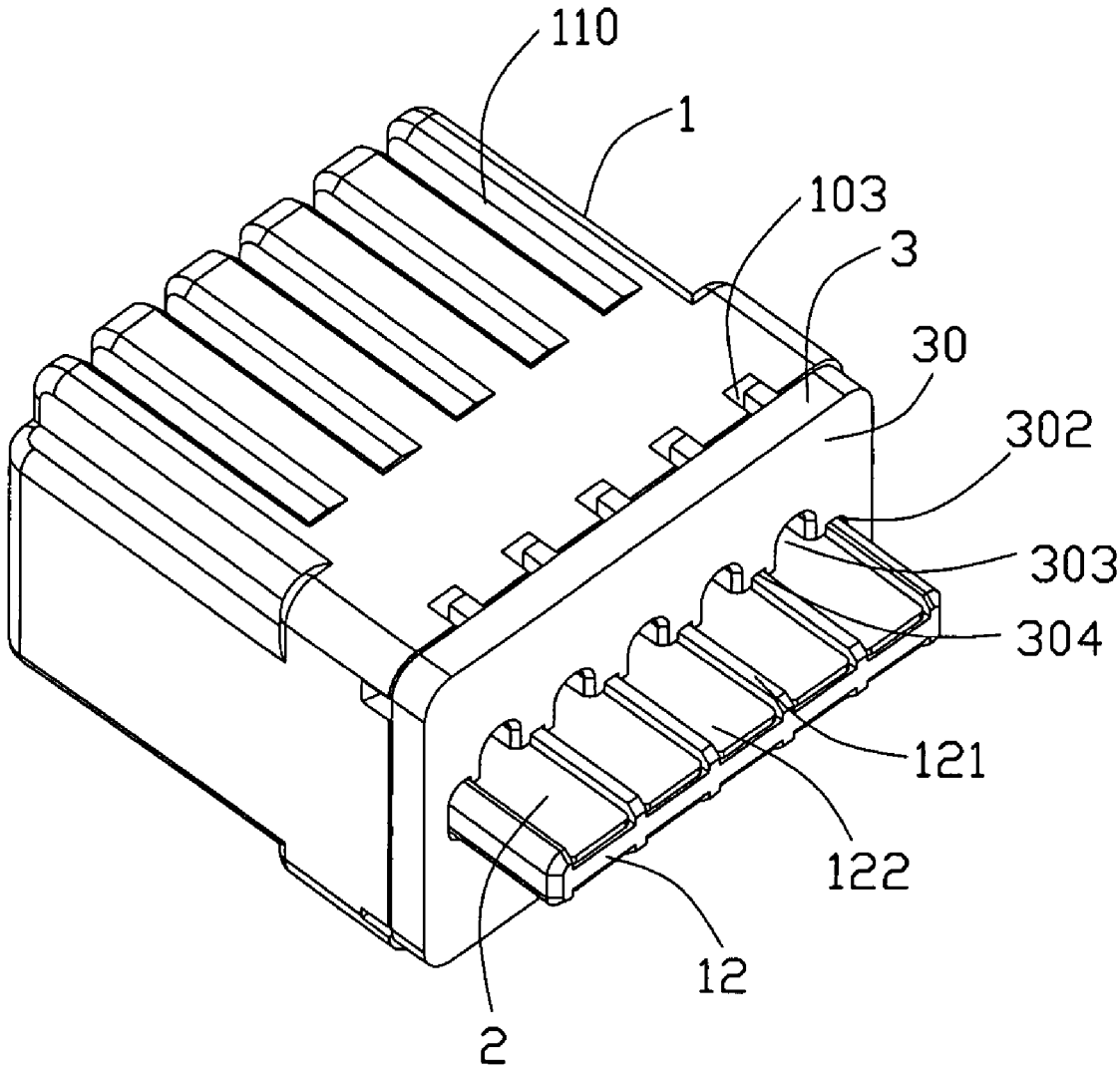
FIG. 4 is a partially assembled, perspective view of the connector assembly of FIG. 2.
Figure 5:
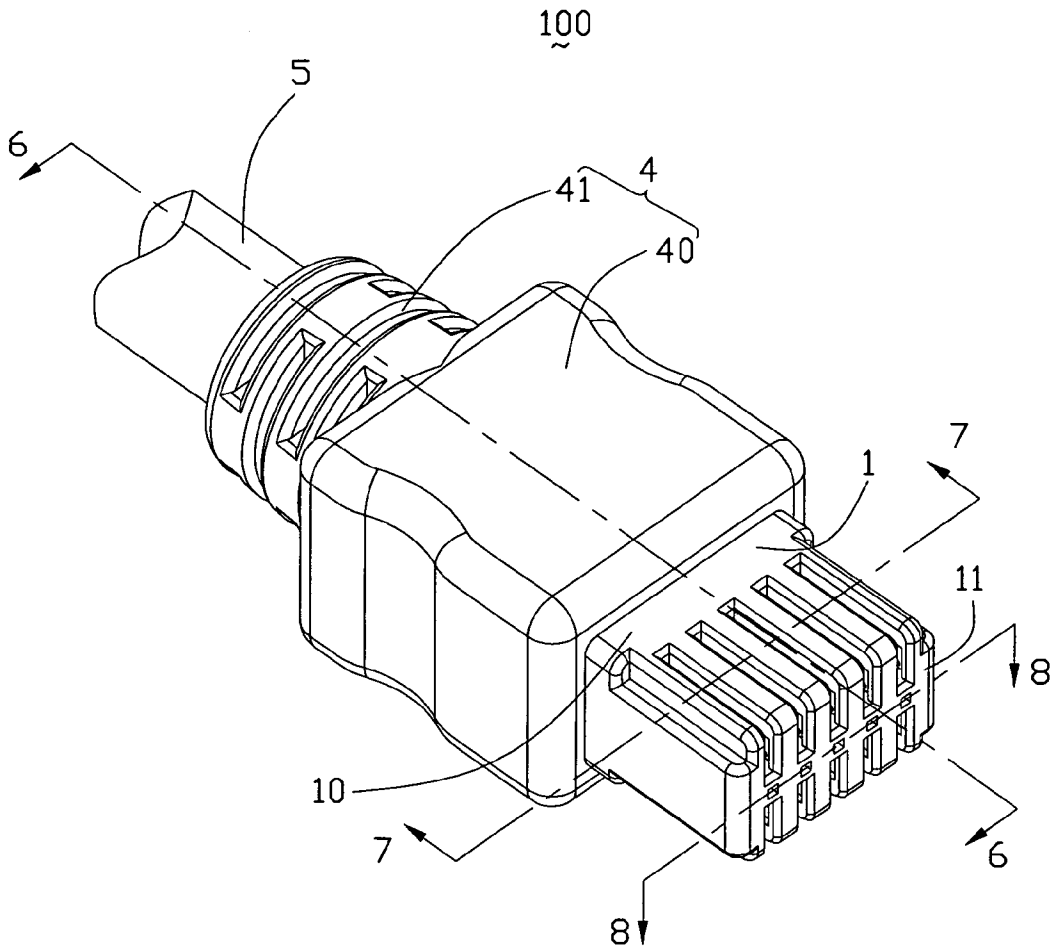
FIG. 5 is an assembled, perspective view of the connector assembly of FIG. 1.

Referring to FIGS. 1-3, the spacer 3 is made from insulative material and comprises a body portion 30 of board shape and a plurality of rectangular protrusions 31 arranged into two rows and extending forwardly from a front surface of the body portion 30. A substantially rectangular through slot 301 penetrates through the body portion 30. Two rows of semicircular holes 303 respectively recess upwardly and downwardly from inner opposite upper and lower edges of the through slot 301 and are arranged to align with corresponding pair of receiving passages 101 in pairs for soldering the conductors of the cable 5 with the conductive contacts 2 conveniently. A plurality of guiding channels 302, 304 with different sizes are recessed from inner surfaces of the through slot 301. The pair of large-size guiding channels 302 are formed at opposite lateral ends of the through slot 301, while the plurality of guiding channels 304 are respectively recessed upwardly and downwardly from upper and lower edges of the through slot 301 for sliding along the partition ribs 121 to guide the assembly of the spacer 3 to the insulative housing 1.

Referring to FIGS. 1-2, the cable 5 comprises a plurality of conductors (not shown, not labeled) exposed outside the outer jacket thereof to electrically connecting with the conductive contacts 2.

The cover 4 is made from insulative material and comprises a front receiving portion 40 and a rear strain relief portion 41 for providing strain relief to the cable 5. The receiving portion 40 forms a pair of handling sections 42 for convenient handle.

In assembly, referring to FIGS. 4-9 in conjunction with FIGS. 1-2, the conductive contacts 2 are assembled to the insulative housing 1 from the rear surface 105 toward the front surface 104 of the insulative housing 1 with first and second flanges 201, 202 slide along the slits 1010 of the receiving passages 101 to guide the insertion of the conductive contacts 2 into the housing 1 and the barbs 222 interferentially engaging with the slits 1010 to securely position the conductive contacts 2 in the housing 1. After the insertion, the main sections 20 of the conductive contacts 2 are respectively received in the receiving passages 101 and the tail sections 23 exposed beyond the rear surface 105 and located in the channels 122 of the supporting portion 12 and divided by the partition ribs 121. The asymmetrically arranged contacting fingers 210, 212 of the first and second flanges 201, 202 are exposed into the receiving passages 101 and can be viewed from the L-shape openings 110. The back-to-back arranged connecting sections 203 of each vertical pair of conductive contacts 2 are received in the same slot 102 with forward edges thereof stopped by the steps 1021 and the pair of retention tabs 224 of the vertical pair exposed into the slot 102 to abut against rear end of the slot 102 for positioning the vertical pair.

Then the spacer 3 is assembled to the insulative housing 1 and the conductive contacts 2. With the guiding channels 302, 304 sliding along the partition ribs 121, the protrusions 31 respectively insert into the receiving passages 101 to occupy the left spaces of the receiving passages 101, and the supporting portion 12 protruding through the through slot 301 of the spacer 3 with the inner edges of the through slot 301 pressing on the tail sections 23 of the conductive contacts 2. The rear pair of protruding points 220 of each conductive contact 2 abut against opposite side surfaces of corresponding protrusion 31 to enhance the engagement between the spacer 3 and the contacts 2, further with the insulative housing 1.

The conductors of the cable 5 are respectively arranged to be inserted into the semicircular holes 303 to locate above corresponding tail sections 23 of the contacts 2 for being positioned relative to the tail sections 23 with the aid of the spacer 3, then the conductors are soldered to the tail sections 23 to form electrical connection therebetween.

The cover 4 is overmolded to above assembly, the main portion 40 thereof encloses the rear portion of the body portion 10, the supporting portion 12, the connection area between the cable 5 and the conductive contacts 2, and the spacer 3. The melted material of the cover 4 flows into the notches 103 for enhancing the connection with the insulative housing 1. The strain relief portion 41 is formed over the outer jacket of the cover 5 to provide strain relief to the cable 5.

After above assembly process, the connector assembly 100 is achieved. Via the asymmetrical structure of the pair of contacting fingers 210, 212, the first gap is always smaller than the second gap which assures the easy stamp and plate process of the conductive contacts 2. That is to say, the asymmetrical structure of the contacting fingers 210, 212 achieves the small first gap, thus, assuring reliable engagement with the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly adapted for electrically connecting with a complementary connector along a mating direction, comprising:

an insulative housing defining a plurality of receiving passages; and a plurality of conductive contacts housed in corresponding receiving passages, each conductive contact comprising a first contacting finger and a second contacting finger extending substantially along an axis defined by said mating direction and respectively exposed in corresponding receiving passage of the insulative housing adapted for electrically engaging with the same contact of the complementary connector, each contacting finger comprising an inclined branch and a contacting point formed at free end of the inclined branch; and wherein the projections of the contacting points of the first and second contacting fingers along a lateral direction perpendicular to said mating direction form a first gap, and the smallest vertical distance between the contacting point of the first contacting finger to the inclined branch of the second contacting finger forms a second gap, and wherein the second gap is always larger than the first gap;

further comprising a spacer assembled to the supporting portion of the insulative housing and sealing the receiving passages of the insulative housing from rear.

2. The connector assembly as claimed in claim 1, wherein the first gap substantially equals to 0 mm.

3. The connector assembly as claimed in claim 1, wherein the first and second contacting fingers partially overlap with each other to cause the first gap is a minus.

4. The connector assembly as claimed in claim 1, wherein the conductive contact is substantially of U-shape, and comprises a first flange, a second flange opposite to the first flange, and a connecting section connecting the first and second flanges, and wherein the first and second contacting fingers respectively are formed with the first and second flanges.

5. The connector assembly as claimed in claim 4, wherein each connecting section of the conductive contact is located in a horizontal plane and forms a retention tab bending slantways therefrom to engage with the insulative housing for retaining the conductive contact in the insulative housing.

6. The connector assembly as claimed in claim 1, wherein the conductive contact comprises a U-shape main section and a fiat tail section extending beyond the receiving passage of the insulative housing for electrically connecting with a conductor of a cable.

7. The connector assembly as claimed in claim 1, wherein the insulative housing comprises a front mating portion and a rear supporting portion, and wherein each conductive contact comprises first and second contacting fingers received in the mating portion, middle retention section interferentially engaging with the mating portion, and a tail section supported by the supporting portion of the insulative housing.

8. The connector assembly as claimed in claim 7, wherein the supporting portion forms a plurality of partition ribs to separate the tail sections of the conductive contacts, and defines a plurality of channels aligning with the receiving passages.

9. The connector assembly as claimed in claim 1, wherein the spacer comprises a body portion and a plurality of protrusions extending forwardly from the body portion, and wherein the protrusions are respectively inserted into the receiving passages to occupy the left space of the receiving passages.

10. The connector assembly as claimed in claim 1, wherein the spacer comprises a body portion defining a through slot to permit the supporting portion and the tail sections protruding therethrough, and wherein the body portion further defines a plurality of semicircular holes communicating with the through slot to locate above corresponding tail sections of the conductive contacts for partially receiving conductors of a cable.

11. The connector assembly as claimed in claim 1, wherein each conductive contact comprises a U-shape main section received in the receiving passage and a rear tail section extending beyond the receiving passage.

12. The connector assembly as claimed in claim 1, each contacting finger of each conductive contact forms a pair of branches bifurcating from a root thereof.

13. The connector assembly as claimed in claim 1, wherein the contacting point of the first contacting finger is in front of the contacting point of the second contacting finger along said mating direction.

14. A connector assembly adapted for electrically connecting with a complementary connector along a mating direction, comprising:

an insulative housing defining a pair of receiving passages aligned with each other along a vertical direction perpendicular to said rusting direction;

at least a pair of upper and lower conductive contacts arranged in said vertical direction and respectively received in corresponding receiving passages, the lower conductive contact is achieved by rotating the upper conductive contact 180 degrees; and wherein each conductive contact comprises a first contacting finger and a second contacting finger opposite to the first contacting finger, and the first and second contacting fingers are asymmetrically arranged; wherein the first contacting finger and the second contacting finger extend rearwardly from a front edge of a frame essentially along a direction opposite to the mating direction, and include inclined branches toward each other with contacting points located at different positions behind said inclined branches in said mating direction.

15. The connector assembly as claimed in claim 14, wherein each contacting finger comprises an inclined branch and a contacting point formed at a free end of the inclined branch, and wherein the projections of the contacting points along a lateral direction perpendicular both to the mating direction and the vertical direction forms a first gap, and a smallest vertical distance between the contacting point of the first contacting finger and the branch of the second contacting finger forms a second gap, and wherein the second gap is always bigger than the first gap.

16. An electrical cable connector comprising:

an insulative housing defining a plurality of passageways extending through opposite front and rear faces thereof;

said passageways being arranged in two rows;

a support platform extending rearwardly from the rear face, a plurality of partition ribs formed on the support platform so as to form a plurality of channels aligned and communicating with the corresponding passageways, respectively;

a plurality of contacts disposed in the corresponding passageways, each of said contacts defining a horizontal tail portion extending out of the rear face and received in the corresponding channel; and a spacer including a vertical body portion with plurality of protrusions extending forwardly from a front face thereof and into the corresponding passageways, respectively; wherein said spacer further defines horizontal through slot through which the support platform extends rearwardly.

17. The cable connector as claimed in claim 16, wherein the spacer further defines a first type guiding channels receiving the partition ribs, respectively.

18. The cable connector as claimed in claim 17, wherein the spacer further defines a second type guiding channels in alignment with the corresponding protrusions, respectively.

19. The cable connector as claimed in claim 18, wherein said second type guiding channel is configured for receiving a portion of a round wire.

* * * * *